US011751680B2

(12) United States Patent
Freeman, Jr.

(10) Patent No.: US 11,751,680 B2
(45) Date of Patent: Sep. 12, 2023

(54) DUAL SURFACE AND REVERSIBLE ERGONOMIC COMPUTER ACCESSORY WITH INTERLOCKING PANELS

(71) Applicant: Innovation Parke LLC, Ridgefield, CT (US)

(72) Inventor: Robert P. Freeman, Jr., Ridgefield, CT (US)

(73) Assignee: Innovation Parke LLC, Ridgefield, CT (US)

( * ) Notice: Subject to any disclaimer, the term of this patent is extended or adjusted under 35 U.S.C. 154(b) by 0 days.

(21) Appl. No.: 17/558,222

(22) Filed: Dec. 21, 2021

(65) Prior Publication Data

US 2023/0189984 A1 Jun. 22, 2023

(51) Int. Cl.
*A47B 21/03* (2006.01)

(52) U.S. Cl.
CPC ..... *A47B 21/0371* (2013.01)

(58) Field of Classification Search
CPC ..... A47B 21/0371; A47B 21/04; A47B 2021/0385
See application file for complete search history.

(56) References Cited

U.S. PATENT DOCUMENTS 5,158,257 A * 10/1992 Wilson ..... A47B 21/0314 D14/457
5,203,845 A * 4/1993 Moore ..... G06F 3/0395 248/118
5,228,655 A * 7/1993 Garcia ..... A47B 21/0371 248/118
5,492,298 A 2/1996 Walker
5,562,270 A 10/1996 Montague
5,628,483 A * 5/1997 Smith ..... A47B 21/0371 248/118
5,678,800 A * 10/1997 Markussen ..... G06F 3/0395 248/118

(Continued)

FOREIGN PATENT DOCUMENTS

CN 204790921 U * 11/2015
CN 204790921 U 11/2015

(Continued)

OTHER PUBLICATIONS

Brombal pivot window youtube video dated Jun. 1, 2021, https://www.youtube.com/watch?v=c1MGRcLnwmY (Year: 2021).*

(Continued)

*Primary Examiner* — Terrell L Mckinnon
*Assistant Examiner* — Ding Y Tan
(74) *Attorney, Agent, or Firm* — Hinckley, Allen & Snyder, LLP; David R. Josephs

(57) ABSTRACT

The ergonomic device accessory supports computer peripherals, such as computer mice and track pads during use, and has two interlocking panel members. The first panel provides a support surface for the peripheral itself while the second panel provides a wrist support surface. The panels pivotally connect to each other and include complementary notches that engage with each other whereby gravity locks the two panels relative to each other, in either a right-handed configuration or a left-handed configuration. When locked, the panels are positioned at optimal angles for ergonomic and comfortable use by the user.

13 Claims, 14 Drawing Sheets

(56) References Cited

U.S. PATENT DOCUMENTS

| | | | | |
|---|---|---|---|---|
| 5,765,790 | A | 6/1998 | Kuldvere | |
| 5,833,180 | A | 11/1998 | Baranowski | |
| 10,045,612 | B2 | 8/2018 | Freeman, Jr. | |
| 2002/0113175 | A1* | 8/2002 | Dillon | A47B 21/0371 248/118 |
| 2008/0024964 | A1* | 1/2008 | Lev | G06F 1/1679 361/679.21 |
| 2017/0188700 | A1* | 7/2017 | Freeman, Jr. | A47B 21/0371 |
| 2019/0281976 | A1* | 9/2019 | Taylor | A47B 23/043 |
| 2020/0163453 | A1* | 5/2020 | Crockett | A47B 21/0314 |
| 2021/0137262 | A1* | 5/2021 | Sauvage | A47B 21/0371 |

FOREIGN PATENT DOCUMENTS

| | | | |
|---|---|---|---|
| DE | 202013010286 | U1 | 12/2013 |
| KR | 20020094473 | A | 12/2002 |
| KR | 201315646 | | 6/2003 |
| KR | 20070042795 | | 4/2007 |

OTHER PUBLICATIONS

Space Seal store wool felt mouse pad sold on amazon.com dated Jul. 14, 2020, https://www.amazon.com/Non-Slip-Felt-Desk-Rubber-Multifunctional/dp/B08CXX5T8P (Year: 2020).*

Pivot door company pivot door webpage, web archive date: Jun. 18, 2016, https://www.pivotdoorcompany.com/ (Year: 2016).*

"Workez Keyboard Tray", http://www.uncagedergonomics.com/workez-keyboard-tray/ (Accessed Jan. 29, 2016).

"Fully Adjustable Keyboard Mouse Tray", http://www.wayfair.com/Cotytech-Fully_Adjustable_Keyboard-Mouse-Tray-KGB-5A-PGY1096.html (Accessed Jan. 29, 2016).

"Sidus Mouse Pad for Musculosketal Disorder Prevention", http://www.gobizkorea.com/catalog/product_view.jsp?blogId=wisemen7172&0bjId=957093 (Accessed Jan. 29, 2016).

* cited by examiner

DUAL SURFACE AND REVERSIBLE ERGONOMIC COMPUTER ACCESSORY WITH INTERLOCKING PANELS

BACKGROUND OF THE INVENTION

The present invention relates generally to accessories for computer peripherals and other devices, such as input devices in the nature of mice, trackballs, track pads, calculators, adding machines, for example, and more particularly to a dual surface, reversible, ergonomic accessory for computer peripherals that provides improved wrist support.

Humans spend an increasing amount of time working with computers and other hand and finger operated devices that require using peripheral devices such as computer mice or trackpads/touchpads.

However, the vast majority of computer peripherals were not designed with ergonomic use in mind. In some cases, the repeated use of these conventional computer peripherals may result in poor wrist posture, which, combined with prolonged repetitive use can lead to physical discomfort in the wrist, hand or forearm.

According to ergonomics researchers at Cornell University, our wrists are not meant to be positioned horizontally on a flat surface, such as a desktop, for prolonged periods.

The most common poor wrist position when using a computer mouse or trackpad/touchpad is referred to as "full pronation" or "pronated palm down position", which can create muscular and skeletal strain in the user's wrist and/or arm. The posture is unnatural in two ways: 1) wrist extension and 2) forearm pronation.

Full pronation/palm down is the worst position for your wrist to be in as it can cause increased musculoskeletal discomfort and risk of inflammation.

Users who position their wrists in this manner for prolonged periods may experience intermittent wrist discomfort, such as pins and needles sensations, pain or numbness. In some cases, the design of conventional computer mouse or trackpad peripherals may inadvertently cause the median nerve along the wrist to be compressed, which may result in symptoms of Carpal Tunnel Syndrome, a more serious disorder.

Cornell University researchers suggest that, instead of lying flat in a pronated position, the human wrist and forearm should be at an angle somewhere in between the "neutral rotation" (a position your hand would be in when your arms are resting at your sides) and "full pronation" or palm down.

Therefore, there is a need in the art for a device or method to provide additional ergonomic support to individuals that use computer peripherals for long periods of time.

There is a further need for a computer accessory that supports a computer peripheral, such as a mouse or track pad support device, that is ergonomic.

There is yet a further need for a computer accessory that is reversible for both right-handed use and left-handed use yet can still support a computer peripheral, such as a computer mouse or trackpad.

There is demand for a computer accessory mouse or track pad support device that can be collapsed for compact storage and transport.

There is demand for a computer accessory mouse or track pad support device that is comfortable to use.

There is also a further demand for a device that is manufactured with sustainable materials such as bamboo, merino wool or other rapidly renewable materials.

SUMMARY OF THE INVENTION

The ergonomic device accessory, that supports computer peripherals such as computer mice and track pads or any other device, solves the problems of the prior art by providing an ergonomic support accessory with two interlocking panel members. The first panel provides a support surface for the peripheral itself while the second panel provides a wrist support surface. The panels are preferably pivotally connected to each other and include complementary notches that engage with each other whereby gravity locks the two panels relative to each other, in either a right-handed configuration or a left-handed configuration. When locked the panels are positioned at optimal angles for ergonomic and comfortable use by the user.

The ergonomic computer accessory combines the use of both angled surfaces to keep the user's hand and wrist in a natural posture while working with a computer mouse, computer trackpad/touchpad or other peripheral. The more natural angled position of the peripheral surface provides ergonomic benefits such as reducing the muscular and skeletal strain on the user's hand and wrist. The opposing surface provides wrist support at an angle and is specifically configured to avoid compressing the median nerve, reducing discomfort in the wrist.

The panels of the ergonomic computer accessory of the present invention can be separated so the panels can lay flat relative to each other to facilitate storage and transport when not in use.

The ergonomic computer accessory includes a method and device for providing ergonomic support to the user's hand and wrist for either a computer mouse, trackpad/touchpad or other computer peripheral device. The device of the present invention is envisioned to be capable of accommodating any such device that, for example, can be operated with the hand and/or fingers.

Therefore, it is an object of the present invention to provide an ergonomic accessory that includes an ergonomically designed surface that will accommodate and support most computer peripheral devices, such as computer mice, trackpads, touchpads, and other devices.

It is a general object to provide an ergonomic support accessory that provides a surface made from a material or surface treatment with sufficient friction that keeps the computer or device peripheral from sliding off the working surface of the device.

It is a further object of the present invention to provide an ergonomic support accessory that can be configured and used for either left-handed or right-handed users.

It is yet another object of the present invention to provide a support ergonomic accessory that is collapsible for storage and transport when not in use.

Another object of the present invention is to provide an ergonomic support accessory that is comfortable to use.

BRIEF DESCRIPTION OF THE DRAWINGS

These and other features, aspects, and advantages of the ergonomic support accessory will become better understood with reference to the following description, appended claims, and accompanying drawings where:

DESCRIPTION OF THE INVENTION

Figure 1:
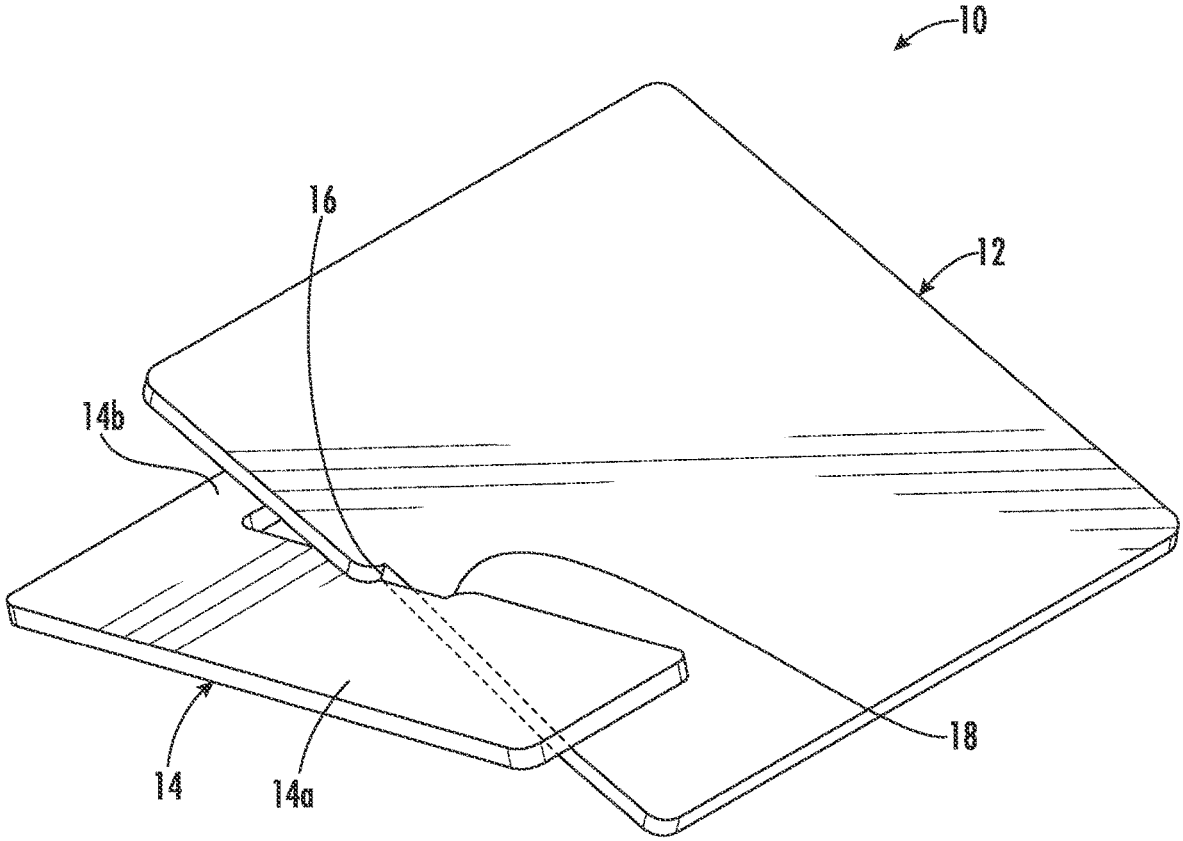
FIG. 1 shows a front perspective view of the ergonomic support accessory of the present invention configured for right-handed use.

The reversible dual surface ergonomic computer accessory assembly 10 of the present invention is shown in detail in FIGS. 1-7. Further options, alternative embodiments and details of various components are shown in FIGS. 8-16.

Turning first to FIGS. 1-4, the ergonomic support accessory 10 of the present invention is shown as configured for right-handed use. A peripheral support panel 12 is pivotally attached to a wrist support panel 14. The peripheral support panel 12 is preferably of a square plan shape but can be of any configuration. The peripheral support panel 12 includes a notch 16 in one edge of the peripheral support panel. The peripheral support panel can be, for example, 8 inches wide and 7.75 inches high and 0.25 inches thick but such dimensions can be changed to suit the user and needs at hand.

Figure 2:
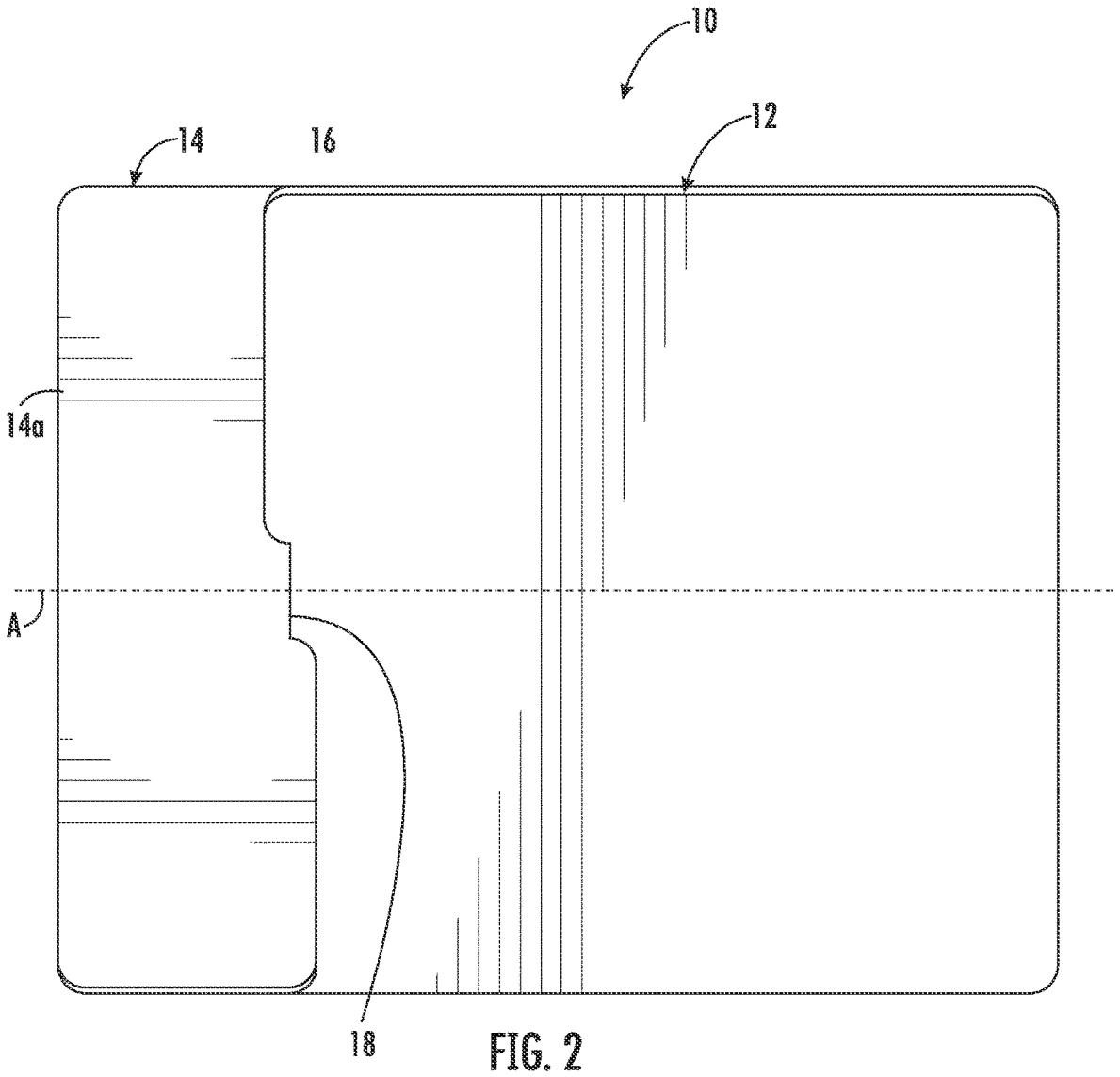
FIG. 2 shows a top view of the ergonomic support accessory of FIG. 1.

The wrist support panel 14 is preferably of an L-shape with a complementary notch 18 on an inner edge of the L-shape panel. As will be shown and described in detail below, the peripheral support panel 12 and the wrist support panel 14 are pivotally connected to each other about an axis A, as seen in FIG. 2, that runs through the respective valleys of each of the notches 16, 18 on the peripheral support panel 12 and the wrist support panel 14. The wrist support panel 14 has a front portion 14*a* that is 8 inches wide and 2.5 inches high and a side portion that is 7 inches high and 1 inch wide. The wrist support panel 14 is also preferably 0.25 inches thick. Such dimensions can be changed to suit the user and needs at hand. Also, the notches 16, 18 in the edges the peripheral support panel 12 and the wrist support panel 14 have side walls 12*b*, 14*b*, respectively, and are preferably radiused for smooth operation and aesthetic appearance with a ¼ inch depth but may be made without radiused side walls 12*b*, 14*b* and may have a deeper or shallower depth depending on the application at hand. It is even possible for the notches 16, 18 to be so deep that a pivot structure may not be needed to maintain the peripheral support panel 12 and wrist support panel 14 in place during use.

Figure 4:
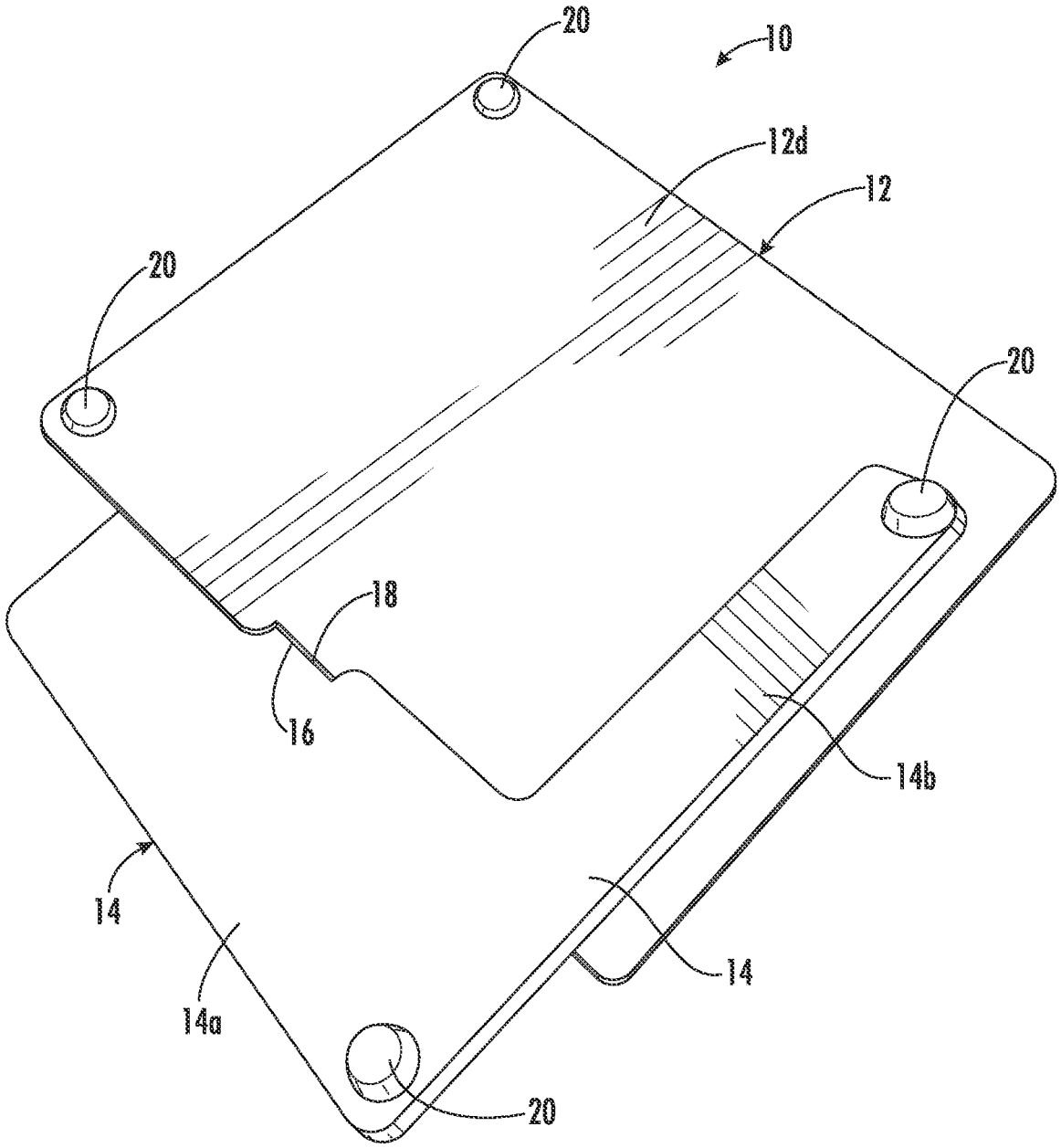
FIG. 4 shows a bottom view of the ergonomic support accessory of FIG. 1.
Figure 5A:
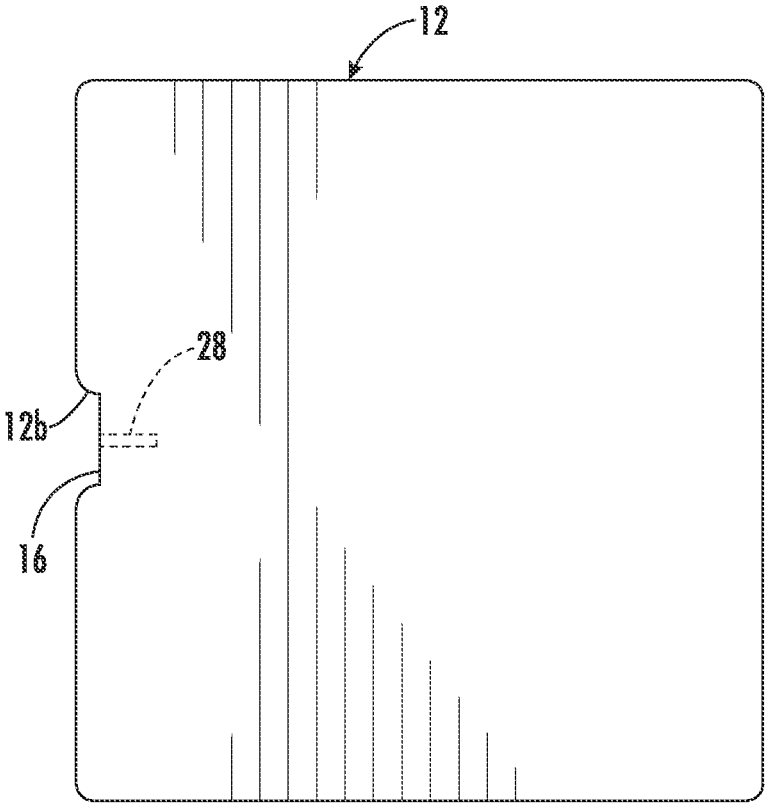
FIG. 5A shows a plan view of the peripheral support panel.
Figure 5B:
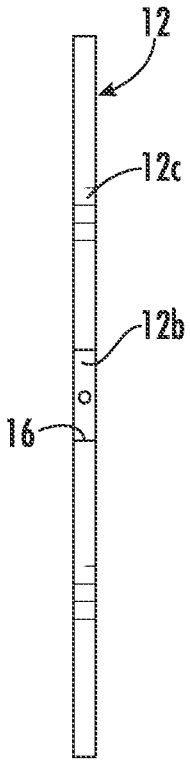
FIG. 5B shows an end view of the peripheral support panel.
Figure 6A:
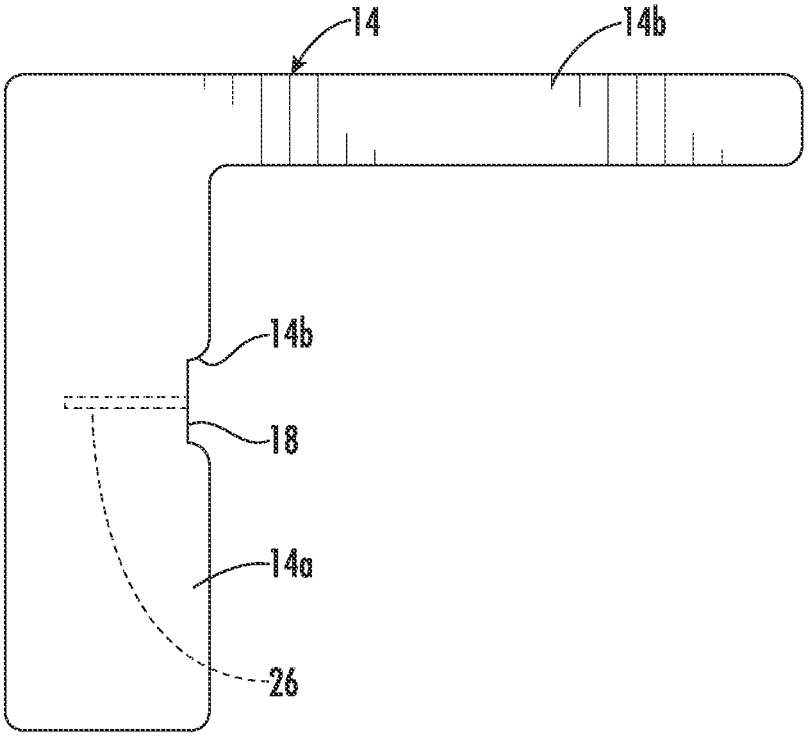
FIG. 6A shows a plan view of the wrist support panel.
Figure 6B:
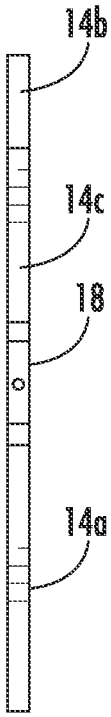
FIG. 6B shows an end view of the wrist support panel.

The interlocking of the peripheral support panel 12 and the wrist support panel 14 is carried out when respective edges 12*c*, 14*c* of the peripheral support panel 12, as best seen in FIGS. 5B and 6B, and the wrist support panel 14 are mated to each other with their notches 16, 18 engaged with one another. For example, in FIGS. 3 and 4, it can be understood that when the peripheral support panel 12 and the wrist support panel 14 are interlocked with one another at their respective notches 16, 18, the left side of the peripheral support panel 14 is resting on the left portion 14*b* of the wrist support panel 14 while the right portion of the wrist support panel 14 is resting on the right portion of the peripheral support panel 12. With the assistance of gravity and the interlocking configuration of the peripheral support panel 12 and the wrist support panel 14 relative to each other, the weight of each respective panels 12, 14 serves to lock the entire combined two-panel structure in place. The bottom view of FIG. 4 further illustrates the interlocking feature of the accessory of the present invention.

The bottom view of FIG. 4 further shows the use of non-slip feet or pads 20 that are adhered to the bottom surface 12*d* of the peripheral support panel 12 and the bottom surface 14*d* wrist support panel 14. The non-slip feet 20 may be of any dimension and may be round, oval or any shape to provide helpful cushioning during use to aid in comfort. Such non-slip feet 20 are preferred but need not be used, if desired.

As stated above, the peripheral support panel 12 and the wrist support panel 14 are pivotally arranged and connected to each other. FIG. 5A shows a plan view of the peripheral support panel 12 while FIG. 5B shows an end view of the peripheral support panel 12. Also, FIG. 6A shows a plan view of the wrist support panel 14 and FIG. 6B shows an end view of the wrist support panel 14. The broken lines in FIGS. 5A and 6A illustrate a first embodiment of a configuration for pivotally connecting the peripheral support panel 12 to the wrist support panel 14 in accordance with the present invention.

Figure 7:
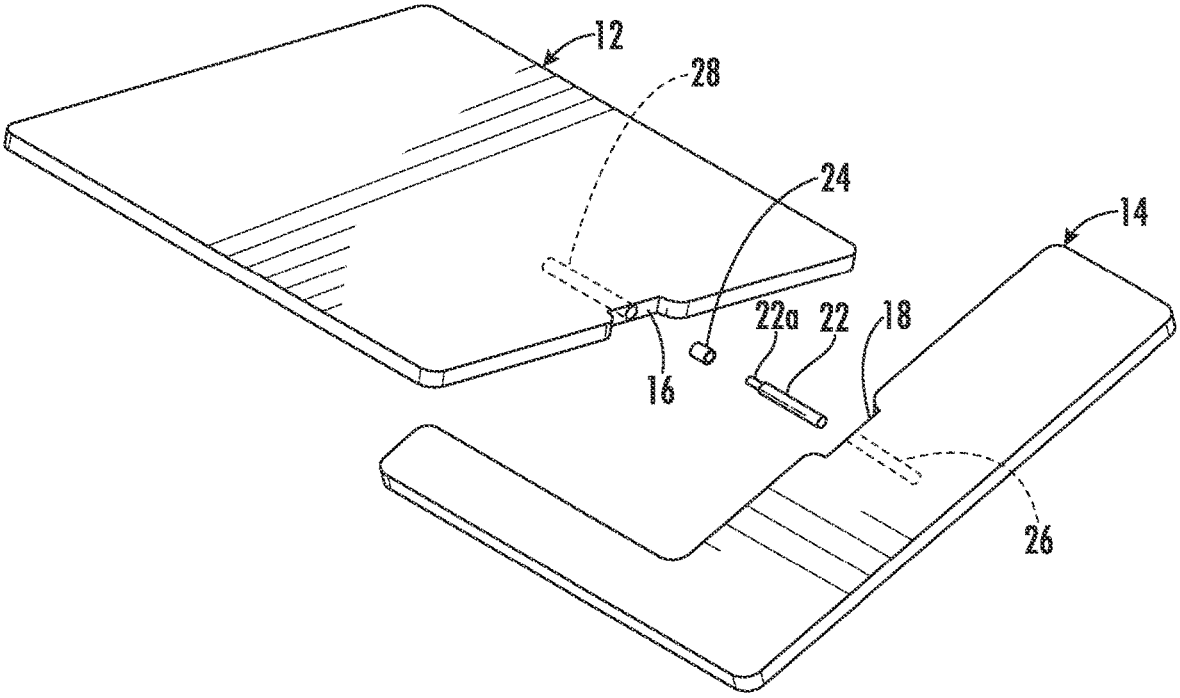
FIG. 7 shows an exploded view of the ergonomic support accessory of the present invention showing a first embodiment of the pivot interconnection between the peripheral support panel and the wrist support panel.

More specifically, FIG. 7 shows the use of a pin 22 and sleeve 24 configuration for carrying out the pivot connection. The pin 22, with a reduced neck portion 22*a*, is embedded in and resides in a bore 26 in the wrist support panel 14. The bore 26 does not pass all the way through the wrist support panel 14 in this embodiment. The main portion of the pin can be 1 inch in length and 0.1475 inch in diameter while the reduced neck portion 22*a* can be 0.25 inch long and 0.1 in diameter. The sleeve 24 is preferably 0.25 inches long with an outer diameter of 0.1875 inch and an inner diameter of 0.1475 inch. As above, these dimensions can adjusted to suit the user and needs at hand and the bores are sizes to receive the respective pin 22 and sleeve 24 with a friction fit, preferably, but a loose fit with some type of adhesive or the like may be employed. The pin 22 and sleeve member 24 are preferably made of brass but can be any other material, as desired.

A sleeve 24 is embedded and resides in a bore 28 in the peripheral support panel 12. The outer diameter of the reduced neck portion 22*a* of the pin 22 has a complementary fit to the inner diameter of the sleeve 24. The pin 22 and sleeve 24 may be friction fit into their respective bores 26, 28 or they may be loose fitted and glued in place. It should also be understood that such a pin 22 and sleeve 24 arrangement may be reversed where the sleeve 24 resides in a bore in the wrist support panel 14 and the pin 22 resides in a bore in the peripheral support panel 12.

Figure 3:
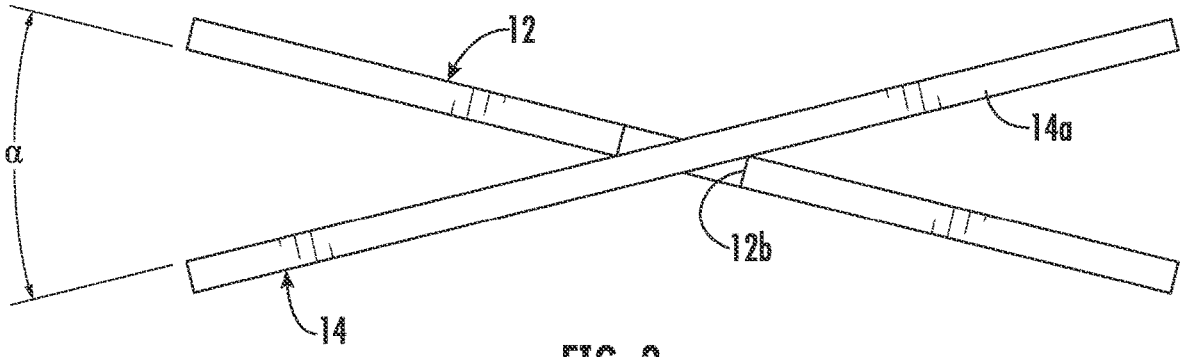
FIG. 3 shows a side elevational view of the ergonomic support accessory of FIG. 1 configured for right-handed use.

Thus, the peripheral support panel 12 and the wrist support panel 14 are maintained proximal to one another with their respective notches 16, 18 aligned for setting the desired panel angle α, as seen in FIG. 3, which may be 28 degrees, for example, but may be any suitable angle. Furthermore, it can be understood that the peripheral support panel 12 and the wrist support panel 14, fit with either a sleeve 24 or pin 22, can be easily interconnected to one another so the accessory 10 can be used and also can be easily separated from one another for transport and storage of the accessory.

As will be described below, there are many different structures and configurations envisioned to carry out the pivotal interconnection of the peripheral support panel 12 to the wrist support panel 14. Any such pivotal interconnection is intended to be within the scope of the present invention.

Figure 8:
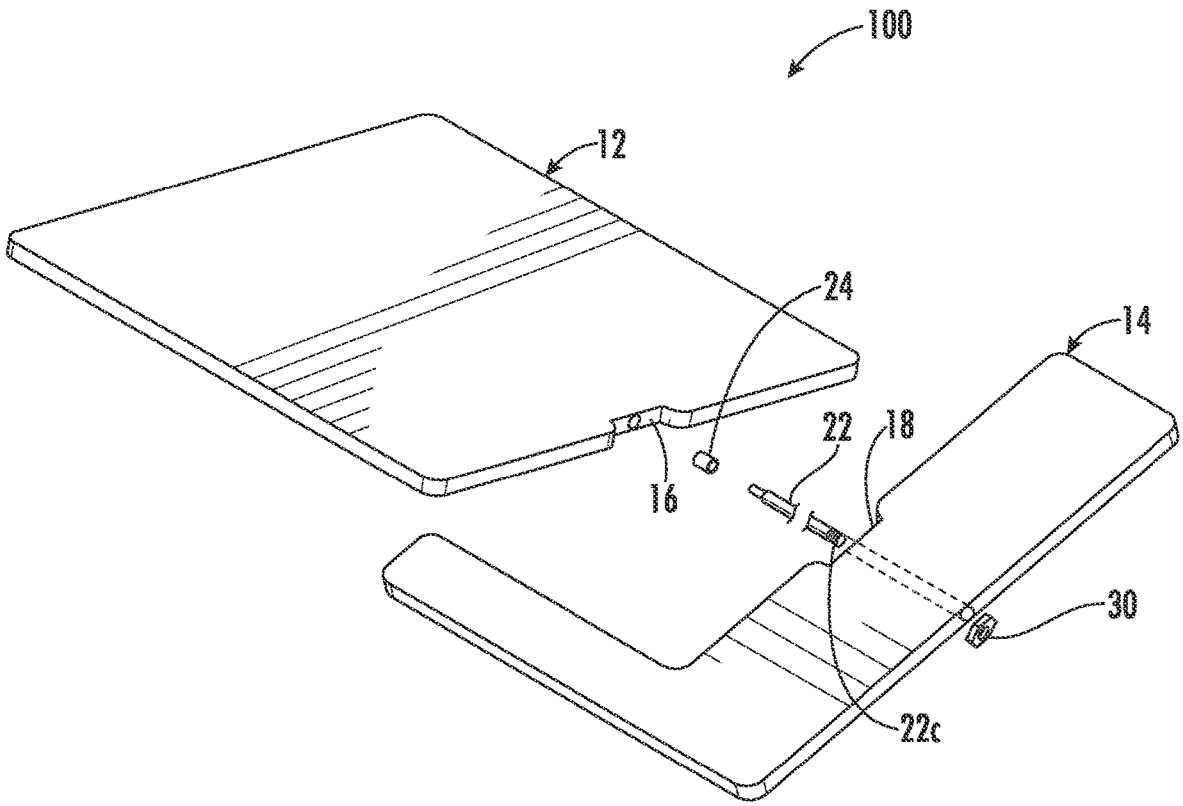
FIG. 8 shows an exploded view of the ergonomic support accessory of the present invention showing a second embodiment of the pivot interconnection between the peripheral support panel and the wrist support panel.

Turning now to FIG. 8, an exploded view of an alternative embodiment 100 of the ergonomic support accessory of the present invention is shown to include a revised pivot interconnection between the peripheral support panel 12 and the wrist support panel 14. In this second embodiment 100, the sleeve 24 is embedded in the peripheral support panel 12 as in the first embodiment of FIG. 7, however, the pin 22 in this second embodiment is elongated and extends completely through the wrist support panel 14, as shown by the broken lines, to provide a free end for engagement with a fastener 30. For example, the free end of the pin 22*c* is preferably threaded for receipt of a nut 30 to secure the pin 22 in place through the wrist support panel 14. This second embodiment 100 operates in, essentially, the same way as the first embodiment 10 to provide a pivot interconnection between the peripheral support panel 12 and the wrist support panel 14 for interlocking thereof.

Figure 9:
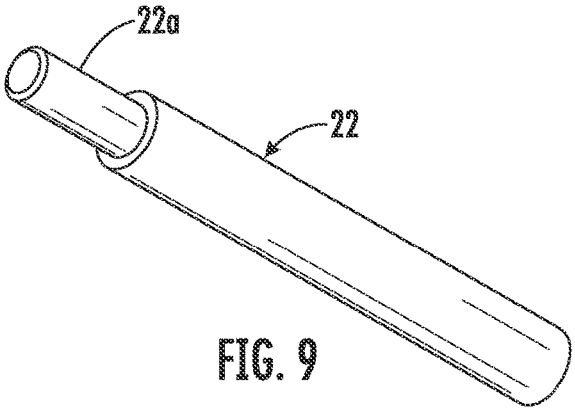
FIG. 9 shows a close-up perspective view of a pivot pin.
Figure 10:
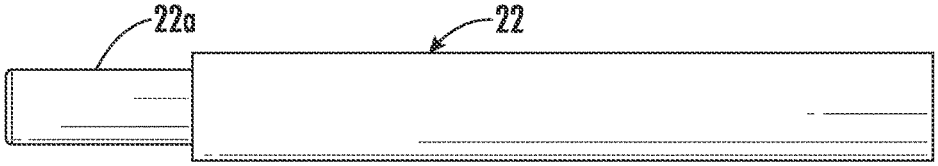
FIG. 10 shows a close-up side view of the pivot pin of FIG. 9.
Figure 11:
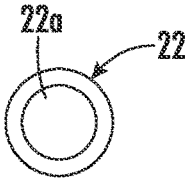
FIG. 11 shows a close-up end view of the pivot pin of FIG. 9.
Figure 12:
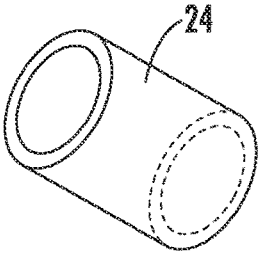
FIG. 12 shows a close-up perspective view of a sleeve that mates with the pivot pin of FIG. 9.

FIGS. 9-12 show close-up view of the pivot interconnection components. FIG. 9 shows a perspective view of one embodiment that employs pivot pin 22 with the reduced neck 22*a*, while FIG. 10 shows a close-up side view of the pivot pin 22 of FIG. 9 and FIG. 11 shows an end view of the pin 22. A pin 22 with for use in the second embodiment of FIG. 8 would include threading 22*c* on the free end thereof as seen in FIG. 8. The sleeve 24 is shown in FIG. 12, which is a cylindrical tube with both ends open. Alternatively, the sleeve 24 may have one end closed (not shown).

Figure 13:
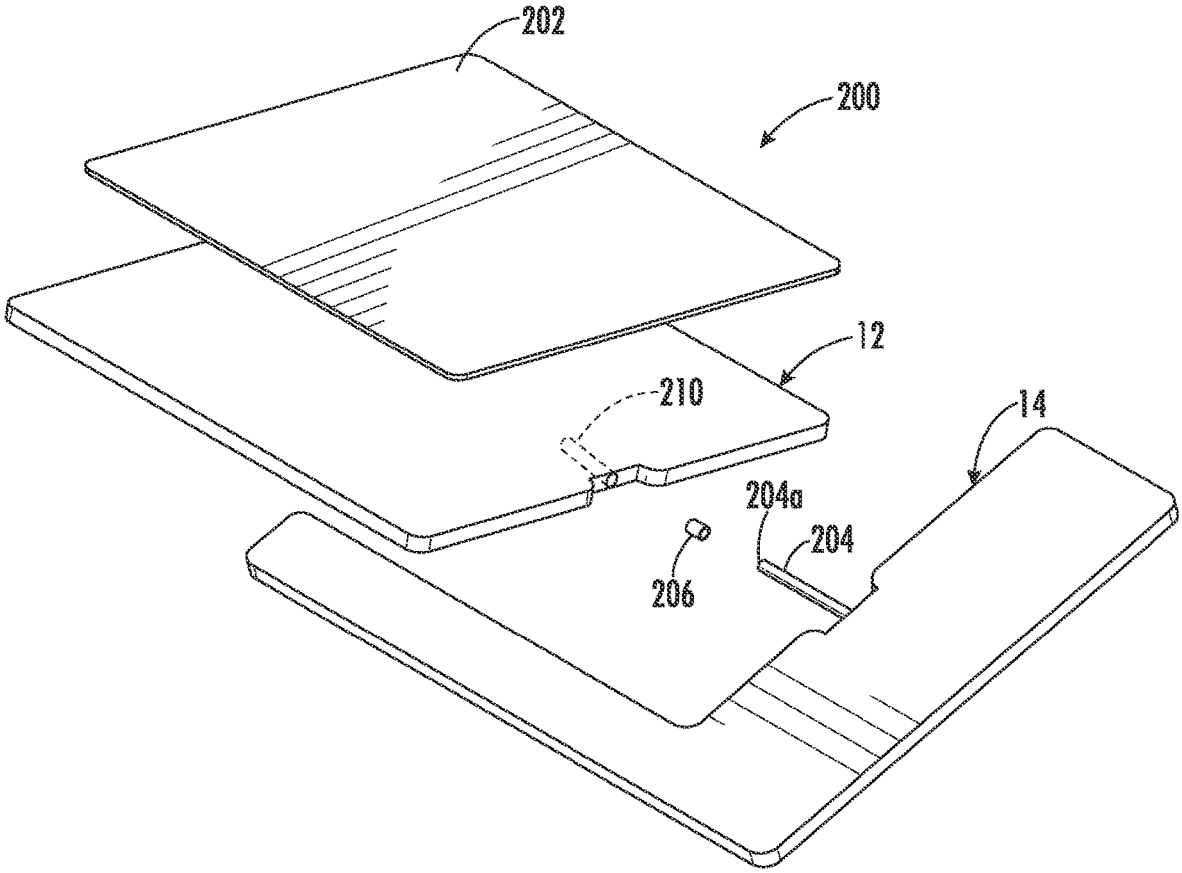
FIG. 13 shows a perspective view of the ergonomic support accessory of the present invention with an optional pad residing on the top surface of the peripheral support panel.

FIG. 13 shows yet another embodiment 200 of the ergonomic support accessory of the present invention with a magnetic pivot interconnection as well as an optional pad 202 residing on the top surface of the peripheral support panel 12. The pivot pin 204 in this third embodiment is embedded in the wrist support panel 14 in similar fashion to the other embodiments, however, the pin 204 is a long magnet pin 204. Instead of a sleeve 24, a locking short magnet 206 is embedded in the bottom of a bore 210 in the edge of the peripheral support panel 12. Thus, the pivoting interconnection of the peripheral support panel 12 relative to the wrist support panel 14 is maintained by magnetic attraction between the free end of the long magnet pin 204 and the locking short magnet 206. The polarity of the long magnet pin 204 and the locking short magnet 206 is configured so these two components attract one another. For example, one magnet would be a (−) polarity and the other would be a (+) polarity.

To connect the peripheral support panel 12 to the wrist support panel 14, the long magnet pin 204 is inserted into the bore 210 of the peripheral support panel, so the free end 204*a* of the long magnet pin 204 magnetically snaps to the locking short magnet 206 in the bore. For removal and separation of the peripheral support panel 12 from the wrist support panel 14, the magnetic attraction is weak enough that a person can pull them apart but strong enough, so the two panels 12, 14 are held in pivoting connection during normal use of the ergonomic support accessory 200.

Figure 14:
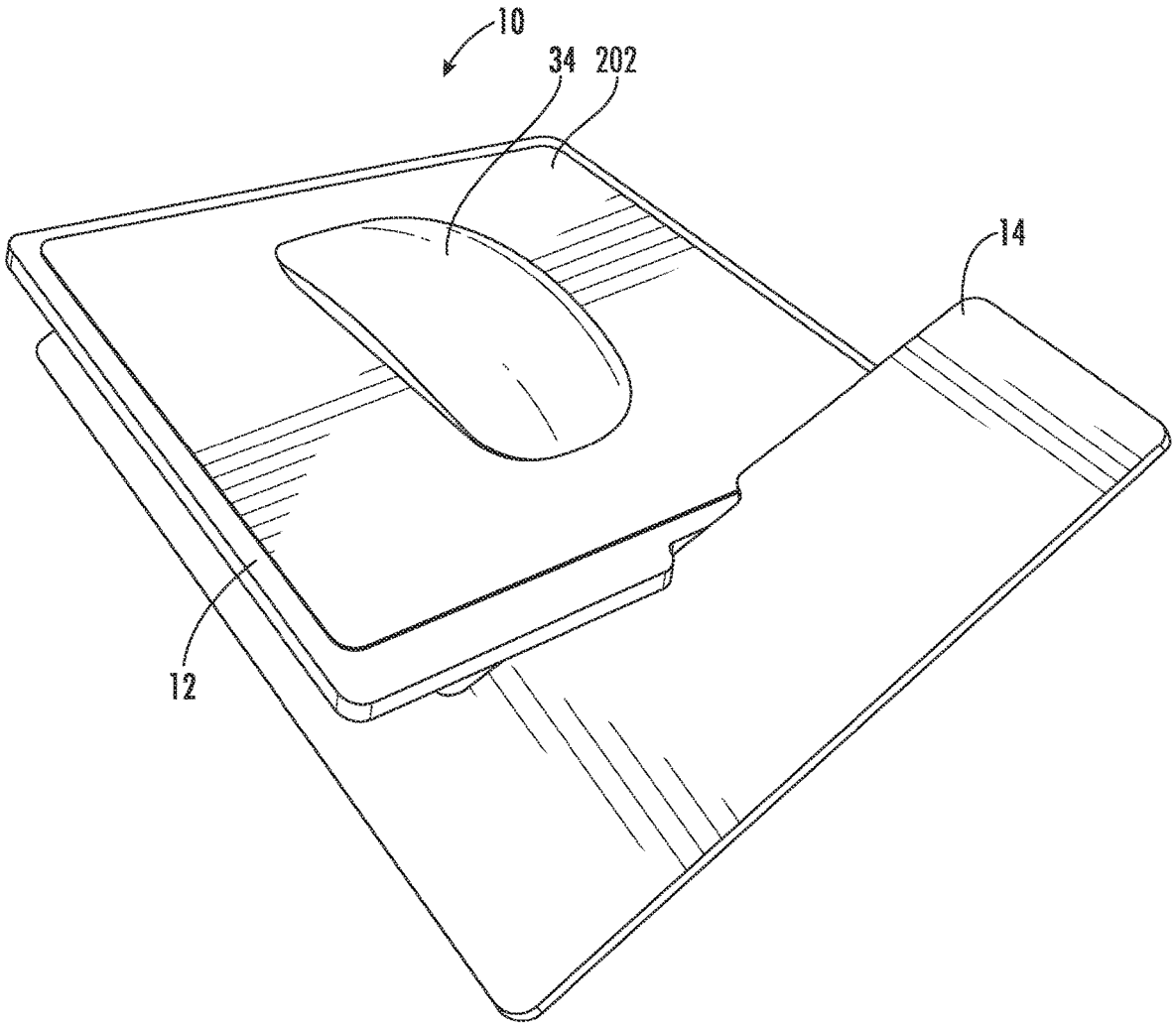
FIG. 14 shows a perspective view of the ergonomic support accessory of the present invention with an optional pad residing on the top surface of the peripheral support panel with a computer peripheral mouse being used thereon.
Figure 15:
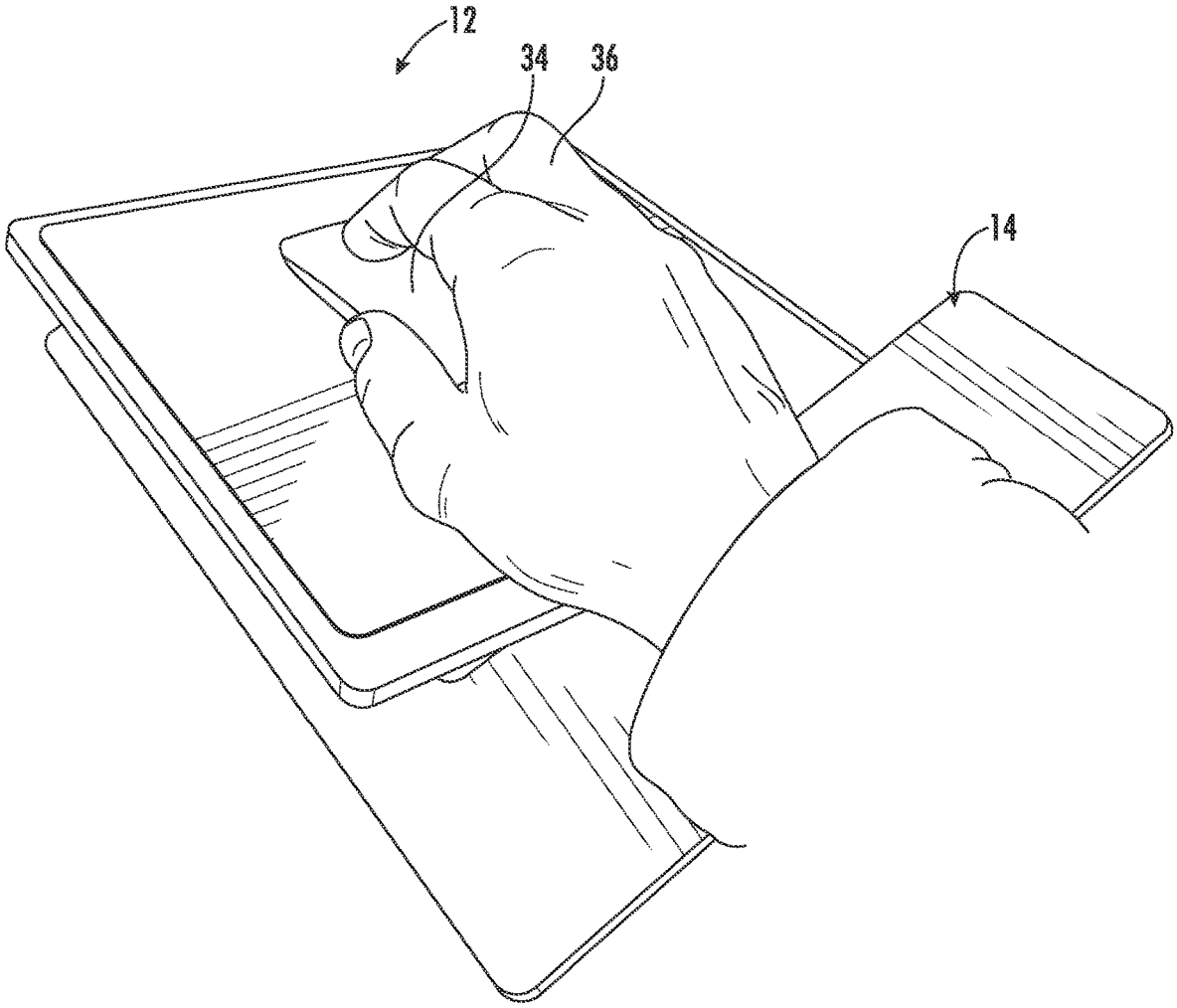
FIG. 15 shows a perspective view of the ergonomic support accessory of the present invention in use in a right-handed configuration.
Figure 16:
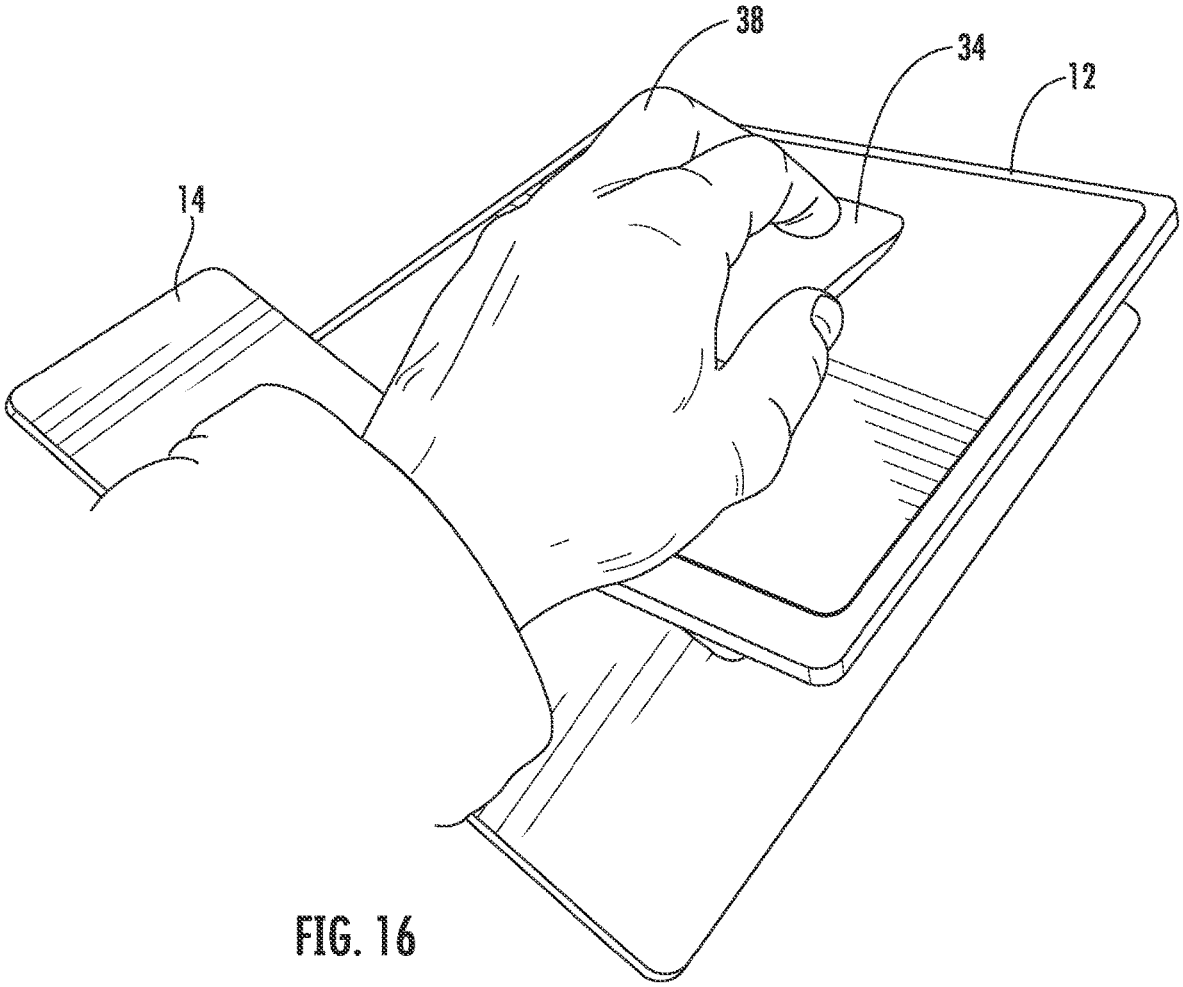
FIG. 16 shows a perspective view of the ergonomic support accessory of the present invention in use in a left-handed configuration.

FIGS. 14-16 show different views of the use of the ergonomic support accessory 10 of the present invention. The first embodiment is shown for illustration purposes, however, the other embodiments are used and adjusted in substantially the same fashion other than the pivot connection feature.

FIG. 14 shows the ergonomic support accessory 10 configured for right-hand use with an optional pad 202 residing on the top surface of the peripheral support panel with a computer peripheral mouse 34 being used thereon. This optional pad can be made of any desired material.

FIG. 15 shows use with the right hand 36 of the ergonomic support accessory 10 of the present invention. In this configuration, the peripheral support panel 12 is angled to the right and the front portion of the wrist support panel 14 is angled to the left. This can also be seen in the front-end view of FIG. 3. Thus, the proper wrist position is maintained when a right hand is used.

Figure 17:
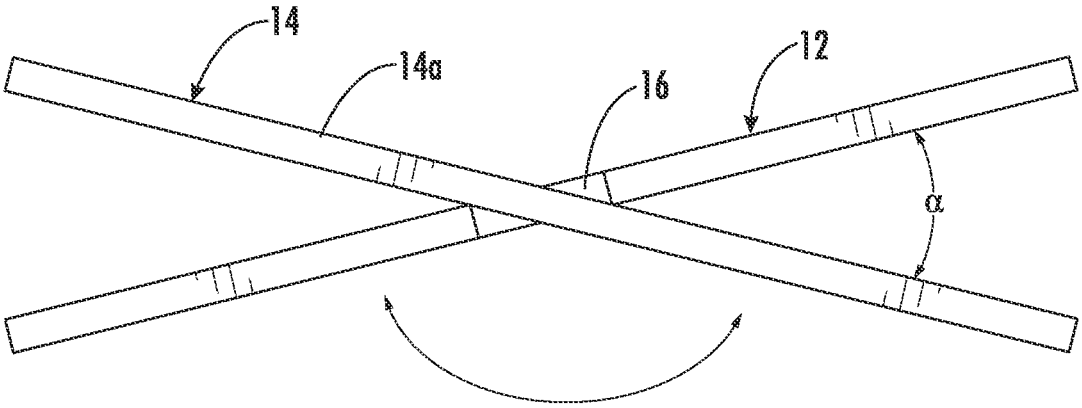
FIG. 17 shows a side elevational view of the ergonomic support accessory of FIG. 1 configured for left-handed use.

FIG. 16 shows a perspective view of the ergonomic support accessory 10 of the present invention when used with a left hand 38 in a left-handed configuration. To achieve this left-handed configuration from a right-handed configuration, the wrist support panel 14 is pivoted counterclockwise about the pivot pin so that the peripheral support panel 12 is angled to the left and the front portion of the wrist support panel 14 is angled to the right. This can also be seen in the front end view of FIG. 17. Thus, the proper wrist position is maintained, with the same angle α, when a left hand is used. Therefore, an angle is maintained that does not compress the carpal tunnel, and, therefore, reduces the risk of injury or pain from prolonged use of the computer peripheral The peripheral support panel 12, wrist support panel 14 may be made of plastic, metal, wood, or any other suitable material that can provide the structure described and be manufactured. For example, the panels 12, 14 may be made of Baltic birch plywood. The working surfaces on the top of each panel 12, 14 may or may not include a non-skid material or treatment to provide enough friction to keep the computer peripheral device, such as a computer mouse 24, trackpad or touchpad will not slide easily when the user removes his or her grip from the peripheral. The working surfaces of the peripheral support panel 12 and the wrist support panel 14 may be made of, or covered with, a flexible and soft, yet resilient material, such as neoprene, Merino wool or any other material for additional comfort and performance of the accessory device 10 of the present invention.

In addition to the features and advantages discussed above, the invention accommodates use with equal benefit by people having hands, wrists and arms of varying sizes. More specifically, each user can rotate the dual surface, ergonomic accessory 10, 100, 200 any desired amount in relation to his or her wrist, hand or arm for maximum comfort to ensure that the user's hand is in the most comfortable position to relieve fatigue.

Therefore, it can be seen that the present invention provides a unique solution to the problem of preventing and reducing wrist and hand injuries in user's that operate computer peripherals for long repetitive periods, by providing an ergonomic support accessory 10, 100, 200 that positions the user's hand between a neutral position and a full pronation position, thereby reducing compression on sensitive nerves and tendons. Furthermore, the pivoting working surfaces of the peripheral support panel 12 and wrist support panel 14 permit the ergonomic support accessory 10, 100, 200 to be easily reversible for both left and right-handed users.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. An ergonomic support accessory, comprising:

a peripheral support panel having a first notch having side walls in an edge thereof and a working surface;

a wrist support panel having a second notch having side walls in an edge thereof and a working surface; the wrist support panel having a substantially L-shape;

whereby the side walls of the first notch and the side walls of the second notch engage with one another to maintain the peripheral support panel relative at an angle relative to the wrist support panel.

2. The accessory of claim 1, further comprising:

a first pivot member residing in the first notch;

a second pivot member residing in the second notch and being complementary to the first pivot member;

whereby the peripheral support panel and wrist support panel pivot relative to one another; the side walls of the first notch and the side walls of the second notch engaging with one another to define an angle of the peripheral support panel relative to the wrist support panel.

3. The accessory of claim 2, wherein the first pivot member is a sleeve and the second pivot member is a pin.

4. The accessory of claim 2, wherein the first pivot member is a pin and the second pivot member is a sleeve.

5. The accessory of claim 2, wherein the first pivot member is locking magnet and the second pivot member is a pin magnet.

6. The accessory of claim 2, wherein the first pivot member is pin magnet and the second pivot member is a locking magnet.

7. The accessory of claim 1, wherein the peripheral support panel and the wrist support panel are positioned at an angle of about 28° relative to each other.

8. The accessory of claim 1, wherein a work surface on the peripheral support panel and a work surface of the wrist support panel are positioned at an angle of about 152° relative to each other.

9. The accessory of claim 1, wherein the peripheral support panel has a substantially rectangular shape.

10. The accessory of claim 1, wherein the working surface of the peripheral support panel and the working surface of the wrist support surface include a non-skid material.

11. The accessory of claim 1, wherein the working surface of the peripheral support panel and the working surface of the wrist support surface include a flexible and soft material.

12. The accessory of claim 11, wherein the flexible and soft material is neoprene.

13. The accessory of claim 11, wherein the flexible and soft material is wool.

* * * * *